US008365356B2

(12) United States Patent
Robertson

(10) Patent No.: US 8,365,356 B2
(45) Date of Patent: Feb. 5, 2013

(54) FRICTION ADJUSTER FOR WINDOW BALANCE CARRIERS

(75) Inventor: Jeffrey Charles Robertson, Rochester, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 234 days.

(21) Appl. No.: 11/553,509

(22) Filed: Oct. 27, 2006

(65) Prior Publication Data

US 2007/0101652 A1 May 10, 2007

Related U.S. Application Data

(60) Provisional application No. 60/731,107, filed on Oct. 28, 2005.

(51) Int. Cl.
*E05D 13/00* (2006.01)

(52) U.S. Cl. ..... 16/193

(58) Field of Classification Search ..... 16/193, 16/197, 199, 214, 220, 284, 296, 315; 49/176, 49/178–182, 445, 447; 403/350, 352; 411/84, 411/85, 15

See application file for complete search history.

(56) References Cited

U.S. PATENT DOCUMENTS

| | | | | | |
|---|---|---|---|---|---|
| 950,537 | A * | 3/1910 | Kunzmann et al. | 16/273 |
| 1,272,039 | A * | 7/1918 | Hausmann | 49/150 |
| 3,127,186 | A * | 3/1964 | Van Renssen | 279/2.19 |
| 4,603,452 | A * | 8/1986 | Paciorek | 16/262 |
| 4,718,194 | A * | 1/1988 | FitzGibbon et al. | 49/181 |
| 5,127,192 | A * | 7/1992 | Cross | 49/181 |
| 5,697,188 | A * | 12/1997 | Fullick et al. | 49/181 |
| 5,898,977 | A | 5/1999 | Muir | |
| 6,012,506 | A | 1/2000 | Wang et al. | |
| 6,058,653 | A * | 5/2000 | Slocomb et al. | 49/181 |
| 6,086,300 | A * | 7/2000 | Frohlich | 411/84 |
| 6,459,887 | B2 * | 10/2002 | Okuda | 455/90.1 |
| 7,024,728 | B2 | 4/2006 | Muir | |
| 7,047,600 | B2 | 5/2006 | Muir | |
| 7,052,222 | B2 * | 5/2006 | Muller et al. | 411/84 |
| 7,537,409 | B2 * | 5/2009 | Huhnerbein | 403/348 |
| 2006/0112642 | A1 * | 6/2006 | Derham et al. | 49/181 |

* cited by examiner

*Primary Examiner* — Robert J Sandy
*Assistant Examiner* — Emily Morgan
(74) *Attorney, Agent, or Firm* — Harness, Dickey & Pierce, P.L.C.

(57) ABSTRACT

A carrier for a window sash having an actuatable friction adjuster. The friction adjuster has a carrier interface that interacts with a mating friction adjuster interface of the carrier such that the actuation of the friction adjuster by rotating it within an oblong slot in the carrier causes the carrier interface to interact with the friction adjuster interface and forces a rear portion of the friction adjuster into progressively increasing frictional contact with an adjacent portion of a window frame sash channel.

11 Claims, 8 Drawing Sheets

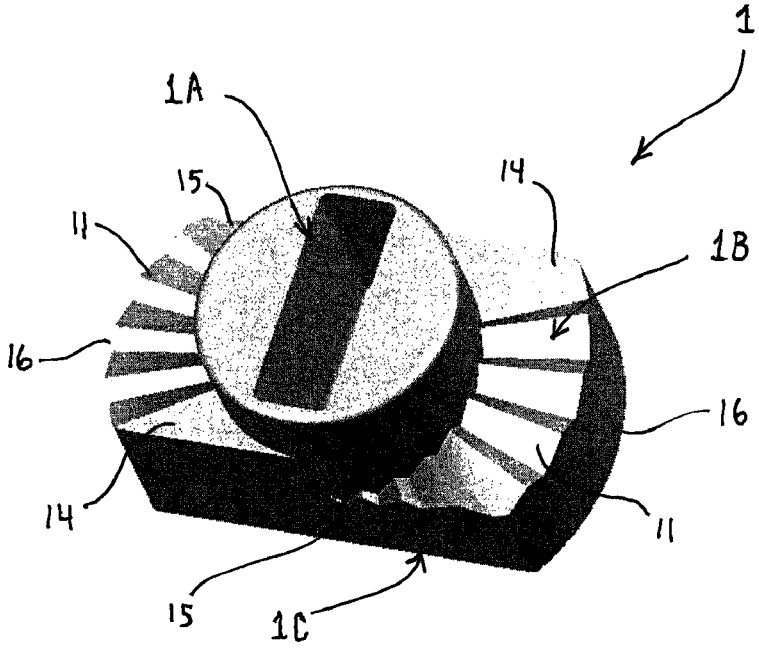
FIG. 1B
FIG. 6
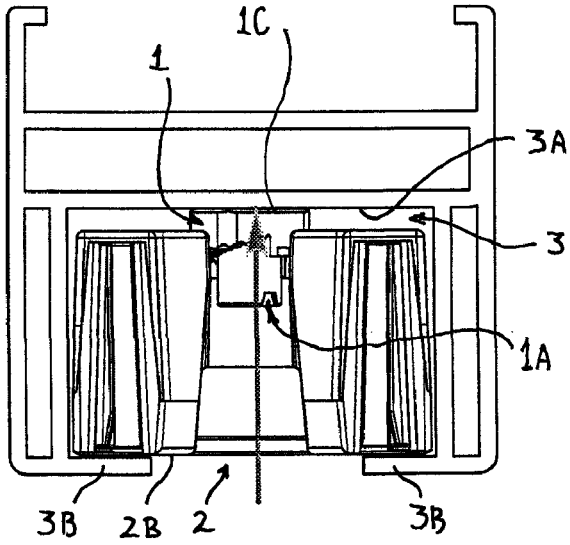

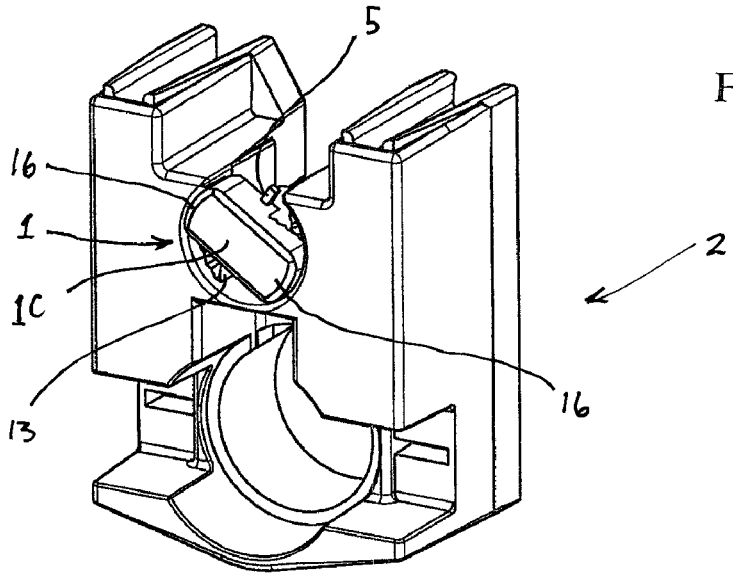
FIG. 8A
FIG. 8B
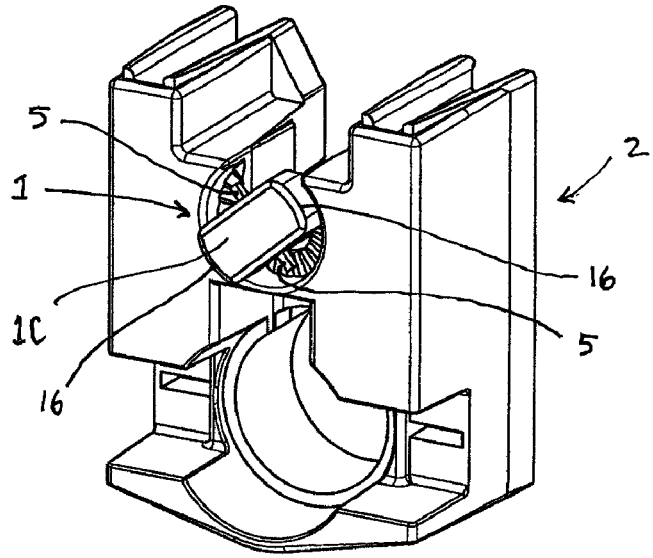

FRICTION ADJUSTER FOR WINDOW BALANCE CARRIERS

REFERENCE TO RELATED APPLICATIONS

This application claims an invention which was disclosed in Provisional Application No. 60/731,107, filed Oct. 28, 2005, entitled "Friction Adjuster For Window Balance Carriers". The benefit under 35 USC §119(e) of the United States provisional application is hereby claimed, and the aforementioned application is hereby incorporated herein by reference.

BACKGROUND OF THE INVENTION

1. Field of the Invention

The present invention pertains to the field of window balance carriers. More particularly, the invention pertains to a friction adjuster for such carriers.

2. Description of Related Art

Window balance carriers are a common part of many window designs. They travel in a carrier channel in the window frame and support a window sash for the window. Within the carrier channel they are connected to a balance for the window. And, in the case of pivoting window sashes, which can be pivoted out of the plane of the window frame for cleaning or other purposes, they are typically provided with locking mechanisms. These locking mechanisms usually include members that are forced tightly against the inner walls of the channel when the sash is pivoted out of the frame. This serves to create a frictional grip between the carrier and the channel preventing the carrier from moving against the upward pull of the window balance even after the window has been pivoted out of the frame and/or removed.

In the usual case, the carrier has a generally rectangular horizontal cross-section and fits snugly albeit slidingly within the rectangular horizontal cross-section of the frame channel. This enables the carrier to slide up and down in the channel without twisting, binding or otherwise moving out of proper alignment within the channel. However, carriers and channels do not always fit together perfectly. Sometimes carriers fit too loosely within the channel. This, among other things, can allow the aforesaid problems to arise and interfere with carrier/window operation. Thus, it would be advantageous to provide a solution to this problem.

SUMMARY OF THE INVENTION

The carrier with friction adjuster of the invention includes, in its most basic embodiments, a carrier for a window sash, and an actuatable friction adjuster for the carrier. The friction adjuster includes a carrier interface which interacts with a mating friction adjuster interface of the carrier such that actuation of the friction adjuster causes the carrier interface to interact with the friction adjuster interface and forces a rear portion of the friction adjuster into greater frictional contact with a portion of a window frame channel. A manipulation interface is provided for use in actuating the friction adjuster using a screw driver or other simple tool.

In the preferred embodiments illustrated, the friction adjuster's carrier interface and the friction adjuster interface of the carrier use a system of mating helical gear steps such that upon the simple rotation of the friction adjuster via the manipulation interface, the friction adjuster is urged outward from the carrier to contact the window frame with increasing frictional force. Finally, the friction adjuster can ideally be molded as part of and connected to the carrier, and held in place by simple break-away connections so that it can be broken away from said connections for use when and if the carrier ever needs tightening in its frame channel.

BRIEF DESCRIPTION OF THE DRAWING

FIG. 1B provides a more detailed perspective view of the friction adjuster of the invention.

FIG. 6 provides a cross-sectional view of the carrier and friction adjuster of the invention positioned in a frame channel.

FIG. 8A provides a perspective view of the friction adjuster of the invention in position in the carrier of the invention, after being rotated. The carrier and friction adjuster are shown from the frame facing side.

FIG. 8B provides a second perspective view of the friction adjuster of the invention in position in the carrier of the invention, after being rotated. The carrier and friction adjuster are shown from the frame facing side.

DETAILED DESCRIPTION OF THE INVENTION

Figure 1A:
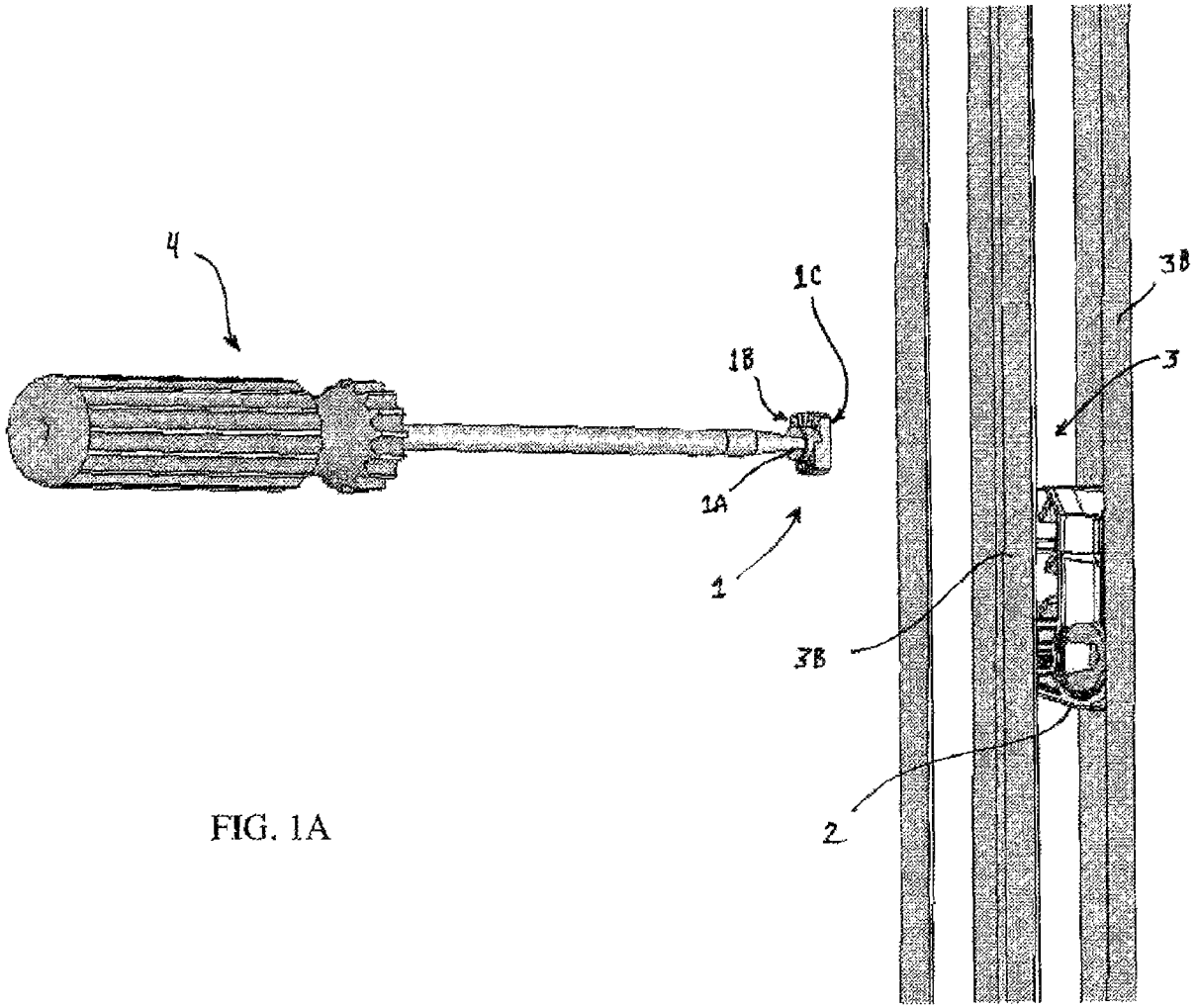
FIG. 1A provides a perspective view of a friction adjuster of the invention in the process of being inserted into a carrier of the invention or, alternatively, after being removed from connection to the carrier. The carrier and friction adjuster are shown from the sash facing side.
Figure 7A:
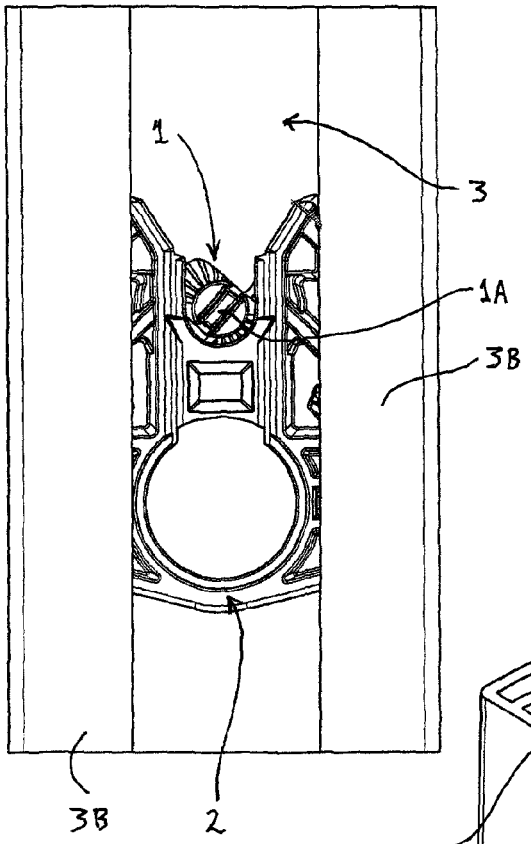
FIG. 7A provides a plane view of the friction adjuster of the invention in position in the carrier of the invention, with both being appropriately positioned in a frame channel. The friction adjuster has been rotated. The carrier and friction adjuster are shown from the sash facing side.
Figure 7B:
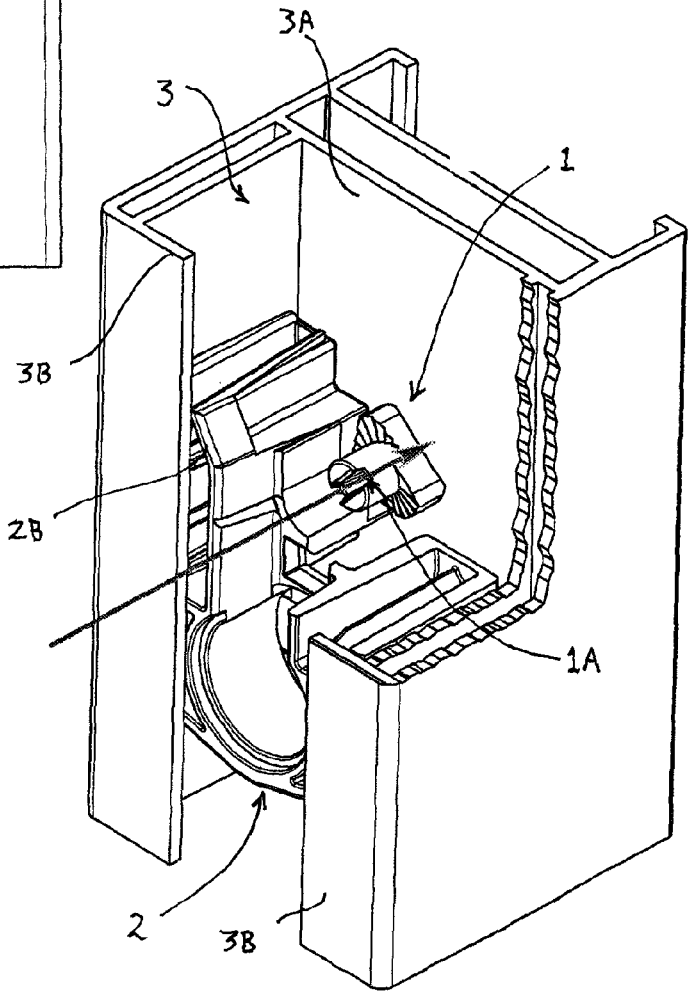
FIG. 7B provides a partial cut-away perspective view of the friction adjuster of the invention in position in the carrier of the invention, with both being appropriately positioned in a frame channel. The friction adjuster has been rotated.

The friction adjuster of the present invention is characterized by the use of an actuatable friction adjuster 1 for a carrier 2 placed in a frame channel 3, as shown in FIG. 1A. The friction adjuster 1 includes a manipulation interface 1A and a carrier interface 1B. The manipulation interface 1A is on the same side of friction adjuster 1 as the carrier interface 1B and is used to manipulate the carrier interface 1B against a mating friction adjuster interface 2A of carrier 2 (refer to FIGS. 3A and 3B). As will be explored in more detail below, manipulation of the manipulation interface 1A causes the carrier interface 2A to interact with the friction adjuster interface 1B so as to force a rear oblong portion 1C of the friction adjuster into varying degrees of frictional contact with a back portion 3A of the window frame channel 3 in which the carrier 2 is positioned (refer to FIGS. 6 and 7B).

Figure 2:
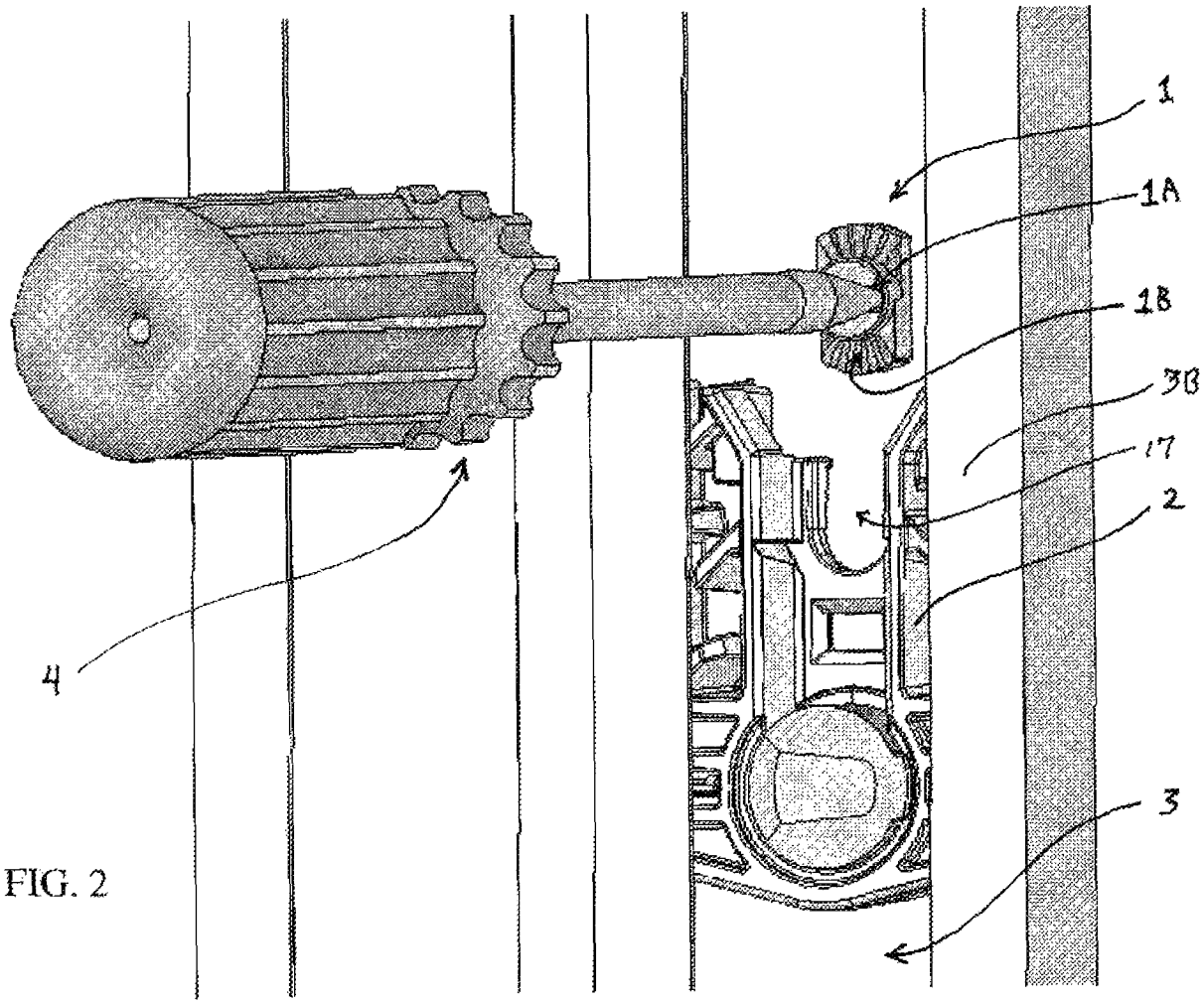
FIG. 2 provides a perspective view of the friction adjuster of the invention as it is being lowered into position into the carrier of the invention or, alternatively, as it is being removed from connection to the carrier. The carrier and friction adjuster are shown from the sash facing side.
Figure 4:
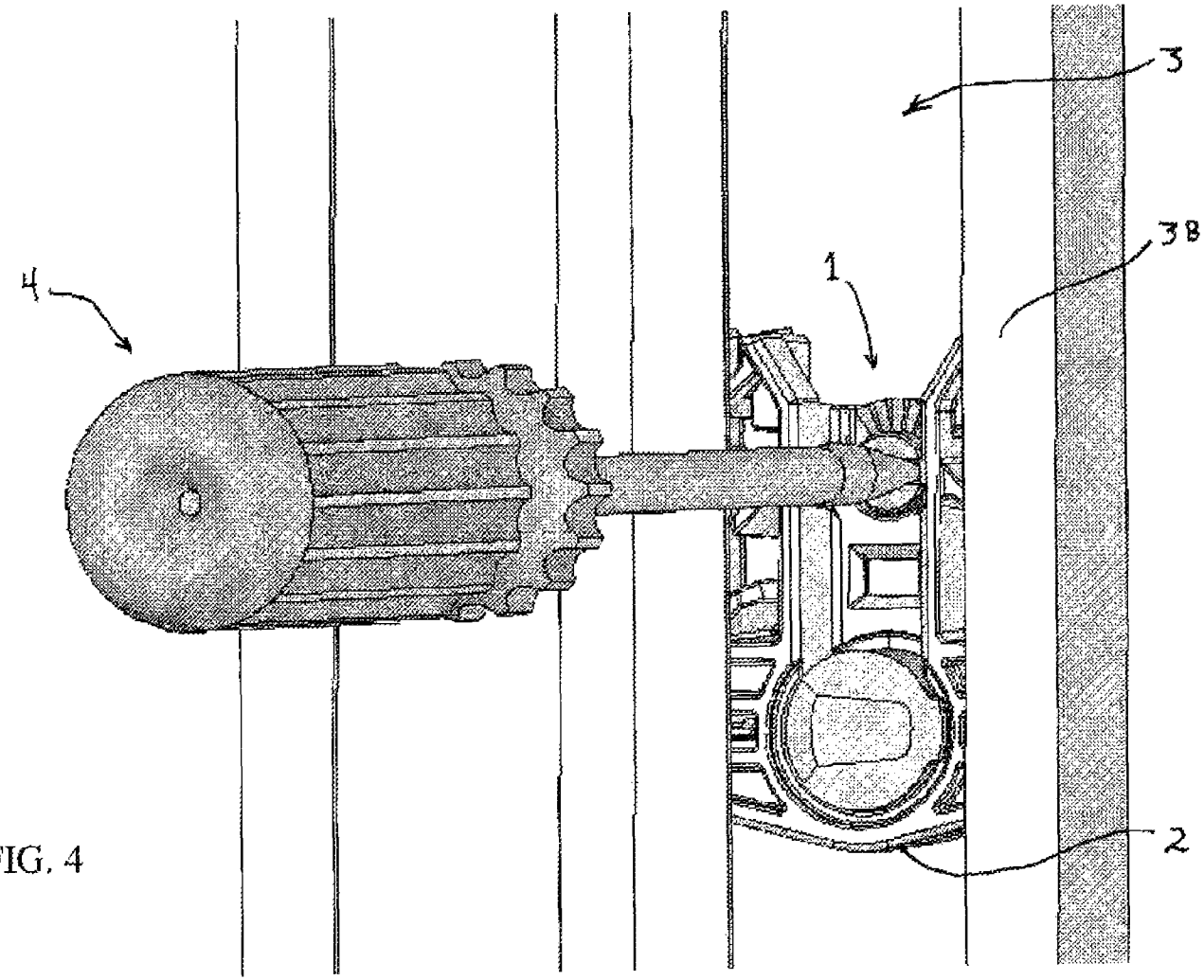
FIG. 4 provides a perspective view of the friction adjuster of the invention in position in the carrier of the invention, prior to being rotated. The carrier and friction adjuster are shown from the sash facing side.
Figure 5:
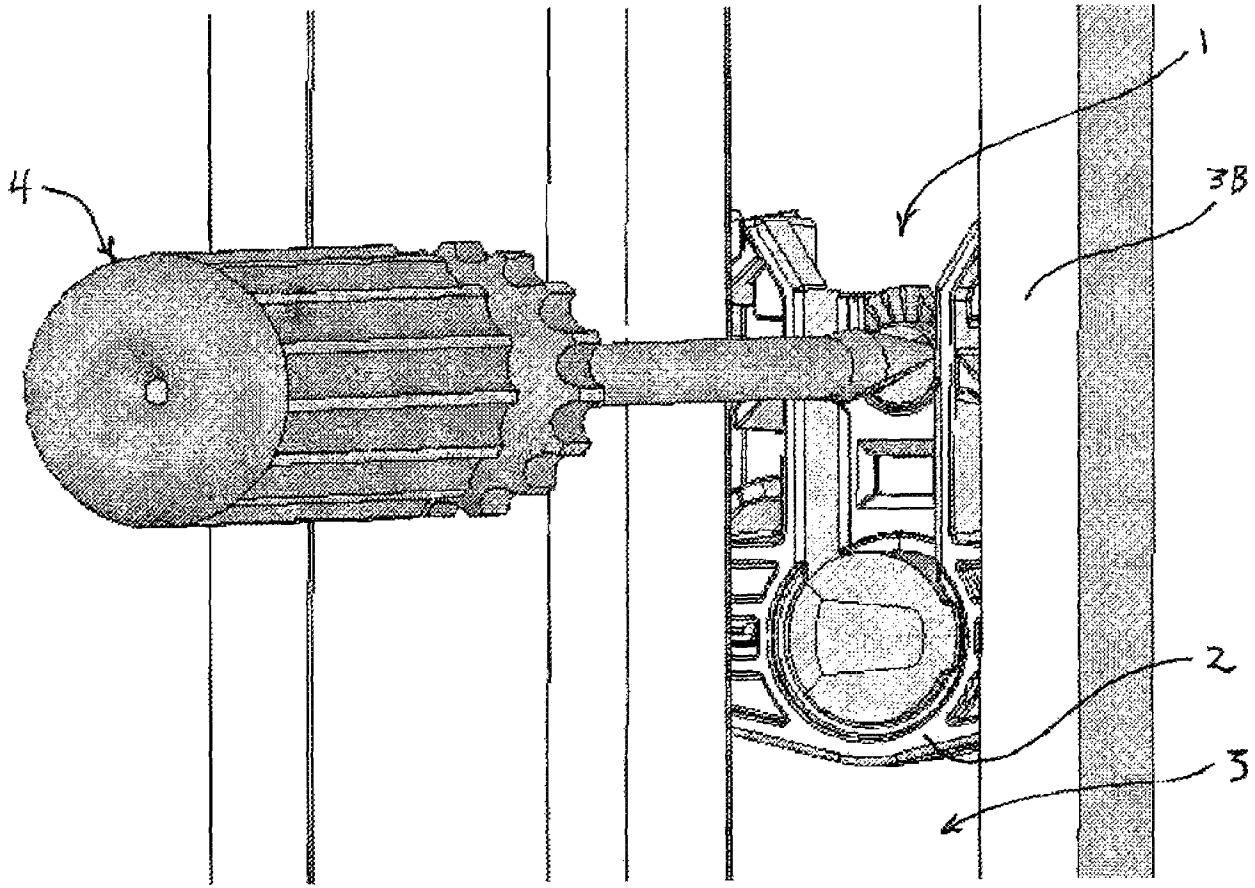
FIG. 5 provides a perspective view of the friction adjuster of the invention in position in the carrier of the invention, after being slightly rotated. The carrier and friction adjuster are shown from the sash facing side.

Ideally, manipulation interface 1A is adapted for use with a manipulation device, e.g. a common tool (such as a screwdriver 4), such that the friction adjuster 1 is actuated by rotation as shown in the drawing figures. Thus, as shown in the sequence illustrated in FIGS. 1A, 2, and 4, friction adjuster 1 (which is shown in greater detail in FIG. 1B) can be inserted into a carrier 2 positioned in the channel 3 of a window frame. It can then be rotated (as illustrated in FIG. 5) to varying degrees so as to bring rear oblong portion 1C into greater or lesser contact with back portion 3A of frame channel 3. (refer to FIG. 6). This not only creates a closer contact between rear oblong portion 1C and back portion 3A, it forces carrier front 2B into closer contact with the inside of frame channel 3 overhangs 3B (best shown in FIG. 7B).

Figure 3A:
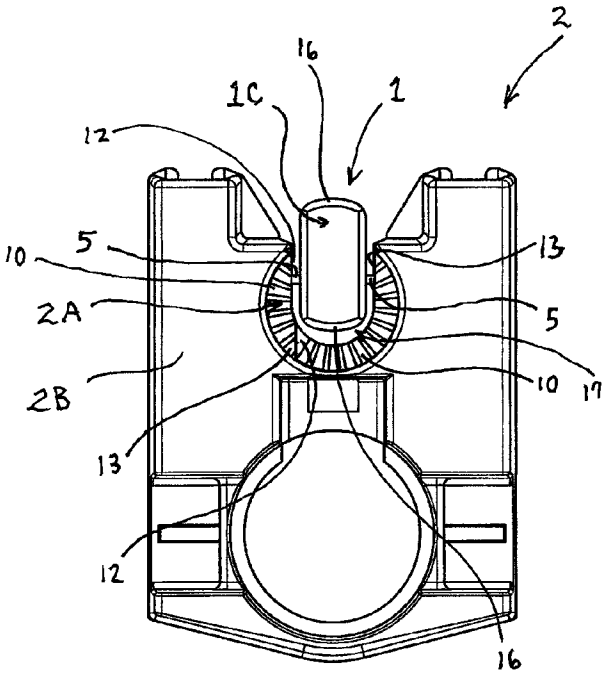
FIG. 3A provides a perspective view of the friction adjuster of the invention prior to being separated from the carrier of the invention. The carrier and friction adjuster are shown from the frame facing side.
Figure 3B:
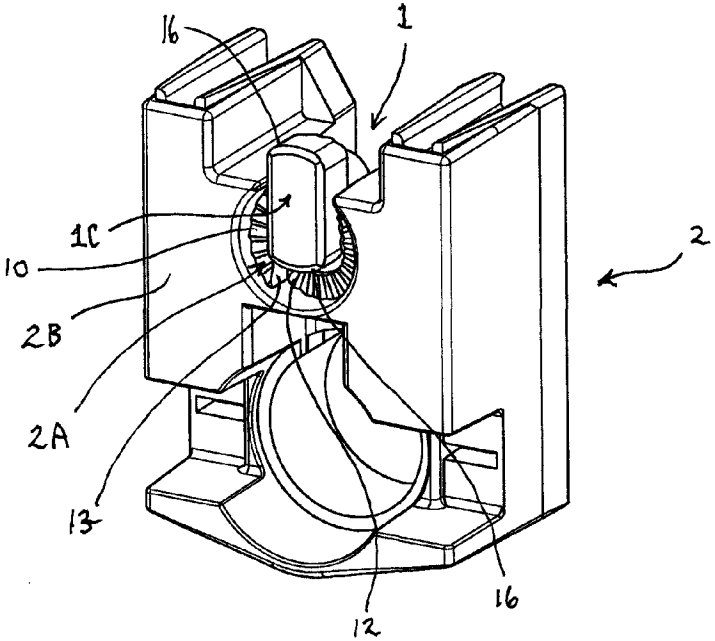
FIG. 3B provides a plane view of the friction adjuster of the invention prior to being separated from the carrier of the invention. The carrier and friction adjuster are shown from the frame facing side.

The present invention relies on the interaction between sets of matched, interfacing helically stepped gear surfaces. The friction adjuster interface 2A of carrier 2 has two opposed sets of carrier helical steps 10, and the carrier interface 1B of friction adjuster 1 has two opposed sets of friction adjuster helical steps 11. As best seen in FIGS. 3A and 3B, the two sets of carrier helical steps 10 start at "low" points 12 and increase in "height" to "high" points 13, with the high point of each set of steps 10 being adjacent the low point of the other set. Likewise, as best seen in FIG. 1B, the two opposing sets of friction adjuster helical steps 11 start at "low" points 15 and increase in "height" to "high" points 14, with the high point of each set of steps 11 being adjacent to the low point of the other set. Thus, when the friction adjuster 1 is rotated so that low points 12 and 15 are adjacent, the friction adjuster 1 is only minimally engaged and minimally extends backwards towards back portion 3A. From this position it can be further turned through intermediate positions until it reaches a point where high points 13 and 14 are adjacent, and it is fully extended towards back portion 3A. In this manner, the present invention allows the effective size of carrier 2 to be adjusted as needed so that it better fits into frame channel 3. In addition, the matched stepped gear configuration allows interface 1 to retain the position to which it is adjusted.

The two sets of friction adjuster helical steps 11 are positioned on outwardly extending tabs 16 of friction adjuster 1 in keeping with its general oblong shape. This shape is advantageous as it allows the friction adjuster 1 to be mounted in and/or to freely slide into oblong slot 17 in carrier 2 without being engaged and to then be turned so as to engage and actuate the friction adjuster 1. In addition, it allows for easy molding of the friction adjuster 1 in oblong slot 17 (either above or adjacent its usual point of engagement) in a manner that allows it to be easily disconnected from the carrier 2 and used for its intended purpose. In keeping with this purpose, only light break-away connections 5 are provided between the friction adjuster 1 and the carrier 2 to facilitate its usage for the aforesaid purposes.

However, many variations are possible without exceeding the scope of the inventive concept described and patented herein. Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A window balance assembly for operation in a window frame channel, the window balance assembly comprising:

a carrier configured to be slidably received within the window frame channel, the carrier including a recessed portion having a plurality of first steps arranged in a first helical pattern, and a slot extending into the recessed portion and including first and second planar sides, a curved end adjacent the first and second planar sides, and an open end formed through a perimeter of the recessed portion and opposing the curved end; and a friction adjuster including a plurality of second steps arranged in a second helical pattern, the friction adjuster being configured to be received into the slot through the open end and rotatably engage the recessed portion, the second steps being engageable with the first steps.

2. The window balance assembly of claim 1, wherein the friction adjuster is configured to contact a back surface of the window frame channel when engaging the recessed portion and is rotatable within the recessed portion between a first position whereby the friction adjuster exerts a first force on the back surface and a second position whereby the friction adjuster exerts a second force on the back surface, the second force being greater than the first force.

3. The window balance assembly of claim 2, wherein the friction adjuster directly contacts the back surface of the window frame channel in the first and second positions.

4. The window balance assembly of claim 3, wherein adjustment of a frictional force between the friction adjuster and the back surface is independent of relative pivotal motion between a window sash and the window frame channel.

5. The window balance assembly of claim 2, wherein the friction adjuster includes a manipulation portion that is accessible through the slot and an opening in a front surface of the window frame channel, the manipulation portion being actuatable to move the friction adjuster between the first and second positions.

6. The window balance assembly of claim 5, wherein the friction adjuster includes an oblong portion extending from the manipulation portion, the plurality of second steps being formed on the oblong portion.

7. The window balance assembly of claim 6, wherein the oblong portion includes a width and a length that is greater than the width, wherein a width of the slot is larger than the width of the oblong portion and smaller than the length of the oblong portion.

8. The window balance assembly of claim 1, wherein relative movement between the first and second steps is independent of relative movement between a window sash and the window frame channel.

9. A method of adjusting a sliding frictional force between a carrier of a window balance assembly and a window frame channel, the method comprising:

providing the carrier with a first helical stepped surface, the first helical stepped surface being formed in a recess formed in a back surface of the carrier, a slot extending into the recessed portion;

installing the carrier into the window frame channel such that the first helical stepped surface faces a back surface of the window frame channel;

providing a friction adjuster having a second helical stepped surface;

installing the friction adjuster onto the carrier after the carrier is installed in the window frame channel; and adjusting a position of the second helical stepped surface relative to the first helical stepped surface after the friction adjuster is installed onto the carrier.

10. The method of claim 9, wherein installing the carrier into the window frame channel includes positioning the back surface of the carrier adjacent the back surface of the window frame channel.

11. The method of claim 10, wherein installing the friction adjuster onto the carrier includes inserting the friction adjuster through the slot formed in the carrier.

* * * * *

UNITED STATES PATENT AND TRADEMARK OFFICE

CERTIFICATE OF CORRECTION

PATENT NO. : 8,365,356 B2
APPLICATION NO. : 11/553509
DATED : February 5, 2013
INVENTOR(S) : Jeffrey Charles Robertson It is certified that error appears in the above-identified patent and that said Letters Patent is hereby corrected as shown below:

In Col. 4, Line 60, Claim 9, replace "recessed portion" with "recess"

Signed and Sealed this
Twenty-sixth Day of March, 2013

Teresa Stanek Rea
*Acting Director of the United States Patent and Trademark Office*